US008006884B2

(12) United States Patent
Ebbesson et al.

(10) Patent No.: US 8,006,884 B2
(45) Date of Patent: Aug. 30, 2011

(54) HAMMER TACKER

(75) Inventors: Jan Ebbesson, Åsenhöga (SE); Björn Söderholm, Mullsjö (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 11/629,708

(22) PCT Filed: Jun. 2, 2005

(86) PCT No.: PCT/SE2005/000834
§ 371 (c)(1),
(2), (4) Date: Dec. 15, 2006

(87) PCT Pub. No.: WO2006/009469
PCT Pub. Date: Jan. 26, 2006

(65) Prior Publication Data

US 2007/0205247 A1 Sep. 6, 2007

(30) Foreign Application Priority Data

Jun. 17, 2004 (SE) ..... 0401546-7

(51) Int. Cl.
*B25C 5/11* (2006.01)

(52) U.S. Cl. ..... 227/147; 227/109; 227/133

(58) Field of Classification Search ..... 227/109, 227/133, 147, 78; 411/444
See application file for complete search history.

(56) References Cited

U.S. PATENT DOCUMENTS

| | | | | | |
|---|---|---|---|---|---|
| 1,671,733 | A | | 5/1928 | Maynard | |
| 1,687,871 | A | * | 10/1928 | Maynard | 227/128 |
| 1,780,530 | A | | 11/1930 | Maynard | |
| 2,303,219 | A | * | 11/1942 | Moe et al. | 227/128 |
| 2,332,257 | A | * | 10/1943 | Polzer | 227/109 |
| 2,445,178 | A | | 7/1948 | Lindstrom | |
| 2,664,565 | A | | 1/1954 | Percoco | |
| 3,113,317 | A | * | 12/1963 | Carlson, Sr. et al. | 227/128 |
| 3,347,439 | A | * | 10/1967 | Doherty | 227/109 |
| 5,421,502 | A | * | 6/1995 | Huang | 227/134 |

* cited by examiner

*Primary Examiner* — Rinaldi I Rada
*Assistant Examiner* — Nathaniel Chukwurah
(74) *Attorney, Agent, or Firm* — Miles & Stockbridge P.C.

(57) ABSTRACT

A hammer tacker (1), which is used to drive staples (8) into a work piece (7), comprises a handle (2) and a magazine (3). The magazine includes a magazine house (4) and a magazine rail (5) which rail is connected to the magazine in such a way that it in its front end (6) can be moved in to and out of (P) the magazine house. Staples stored in the magazine are fed, by a feeding device (24) arranged in the magazine, to an outlet opening (25) in the front end of the magazine. A driver blade (10) housed in the magazine and constituting part of a driver (9) drives the staple fed to the outlet opening into the work piece. The driver (9) is attached to the magazine (3) on the magazine's outer side (19) to facilitate changing the driver blade.

14 Claims, 5 Drawing Sheets view A-A

HAMMER TACKER

TECHNICAL FIELD

The present invention relates to a hammer tacker for driving staples into a work piece, which hammer tacker comprises a handle and a magazine including a magazine house and a magazine rail which is connected to the magazine in such manner that it in its front end can be moved in to and out of the magazine house. Staples stored in the magazine are fed to an outlet opening in the front end of the magazine by a feeding device arranged in the magazine and driven through the outlet opening into the work piece by a driver blade of a driver housed in the magazine.

STATE OF THE ART

A hammer tacker as described above is commonly known. The problem with this known tacker is that when the driver blade has become worn and needs to be replaced, it is complicated to replace the blade since the driver is attached to the inner side of the magazine house. Furthermore, the driver has only one driver blade, which results in a waste of material when a driver blade is replaced since the whole driver needs to be replaced when the driver blade has become worn. Also, because the driver has only one driver blade, it is not possible to accommodate different staple designs with the given driver.

Problem

Consequently, there exists a need to supply a hammer tacker, which comprises a driver, which is easy to replace, and which does not result in a waste of material when one replaces the driver blade, or which has a driver, which includes driver blades of different shapes.

Solution

The present invention overcomes the problems described by means of a hammer tacker, which is characterised in that the driver is attached to the magazine on the magazine's outer side. In a preferred form, the present invention is further characterised in that the driver comprises a first and a second driver blade. The first and second driver blades can be of the same or different design. The driver can be attached to the magazine by a screw arrangement.

BRIEF DESCRIPTION OF THE FIGURES

The invention will hereinafter be described with reference to the appended figures, of which.

PREFERRED EMBODIMENT

Figure 1:
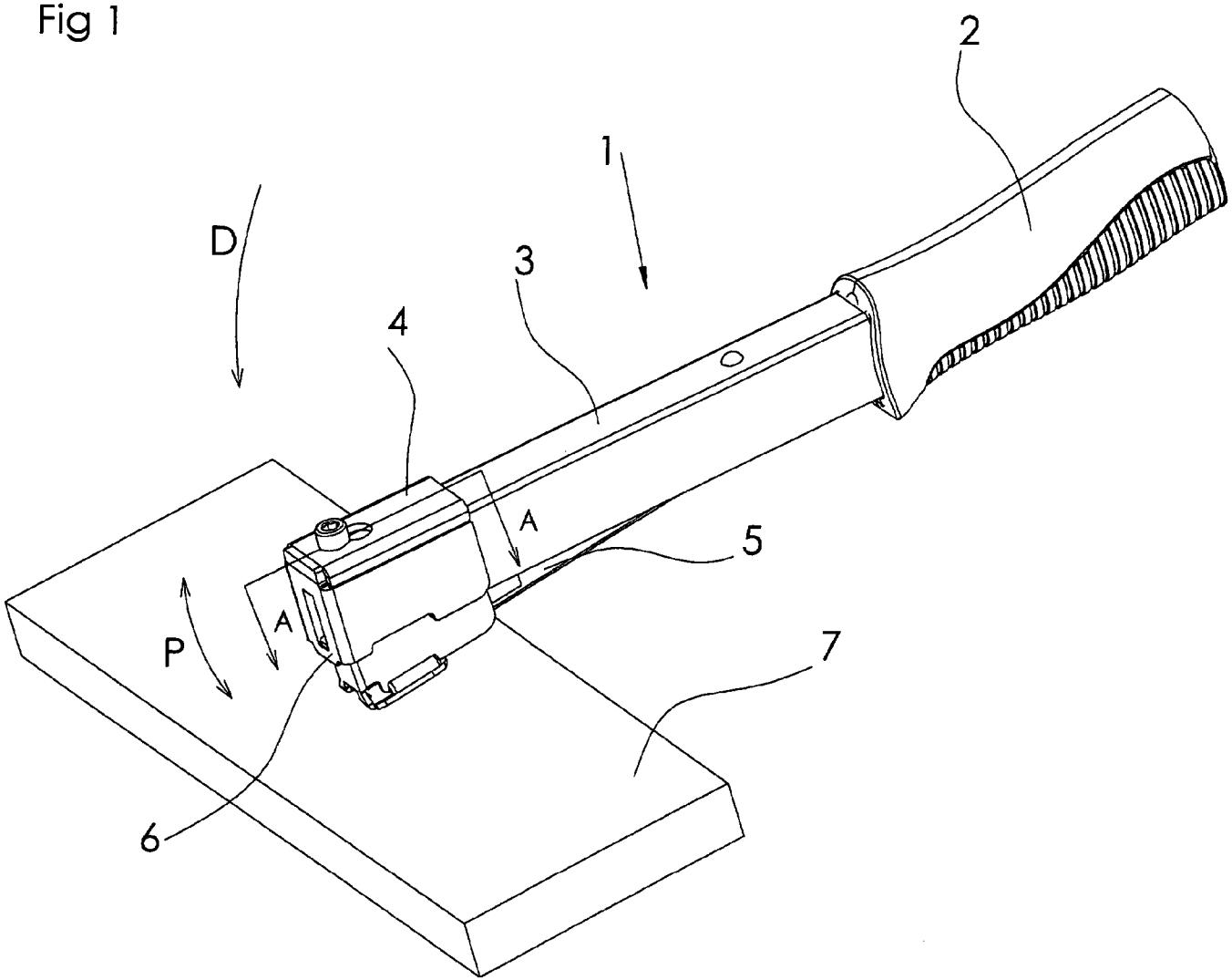
FIG. 1 is a schematic view of a hammer tacker according to the present invention shown in a driving punch and in a position in which it has come to contact with a work piece.

FIG. 1 shows a hammer tacker 1, which comprises a handle 2 and a magazine 3. The magazine comprises a magazine house 4 and a magazine rail 5. The magazine rail is, in known manner, pivotally connected to the magazine house.

Figure 2:
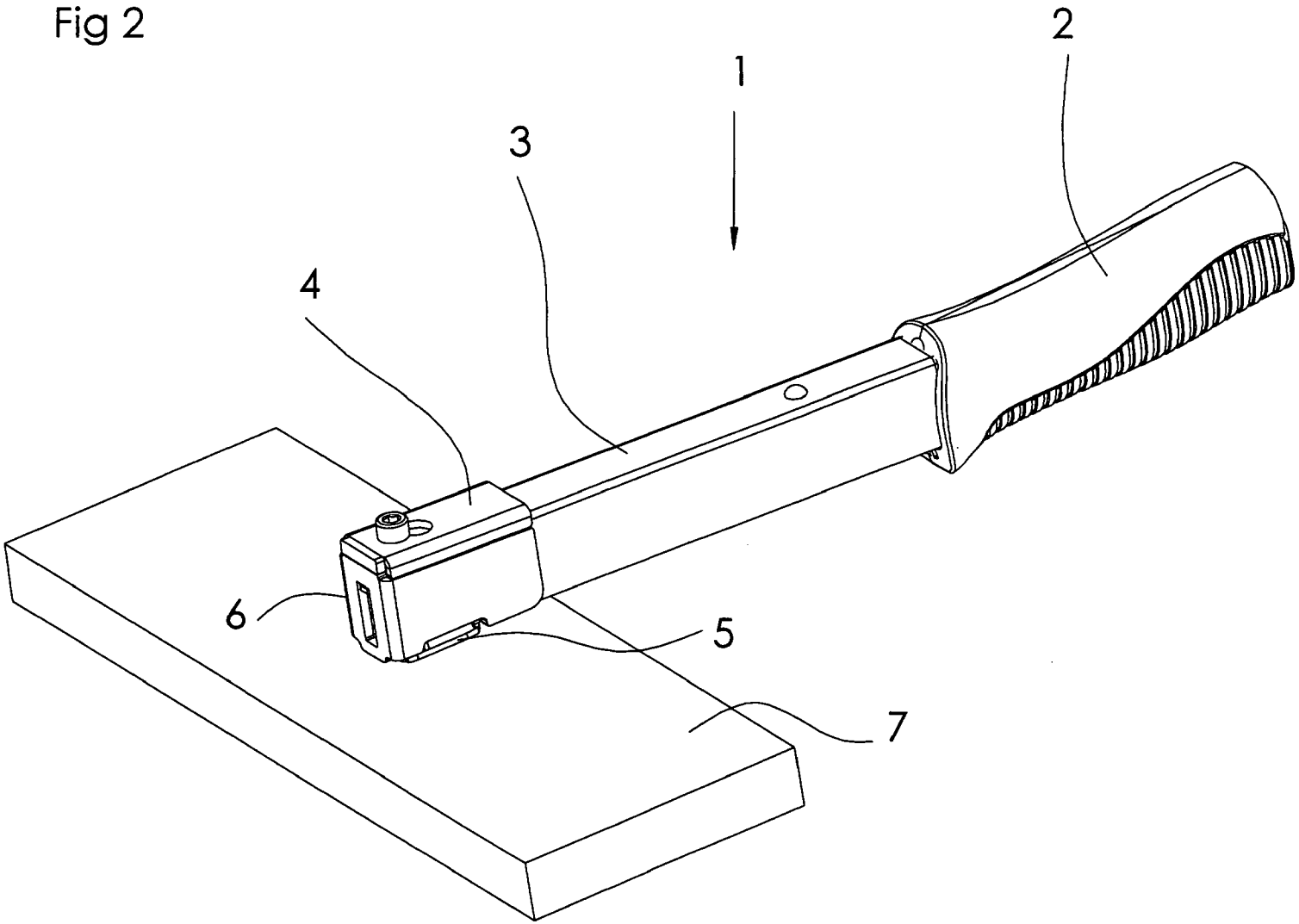
FIG. 2 is a view corresponding to FIG. 1 in which the hammer tacker is in a position in which a staple has been driven into the work piece.

The connection makes it possible to move the magazine rail in to and out of the magazine house in the front end 6 of the magazine house, which movement is indicated by the double arrow P. The figure shows the tacker in a driving punch. The arrow D in FIG. 1 indicates the direction of the punch. The tacker is in a position in which the rail 5 is in contact with a work piece 7 into which a staple 8, shown in FIG. 4, shall be driven. In the position shown in the FIG. 1, the rail is out of the magazine house. FIG. 2 shows the hammer tacker in a position in which it has been moved further in the direction D and in which position the rail has been moved into the magazine house whereby, as will be described hereafter, a staple is pushed into the work piece.

Figures 3, 6:
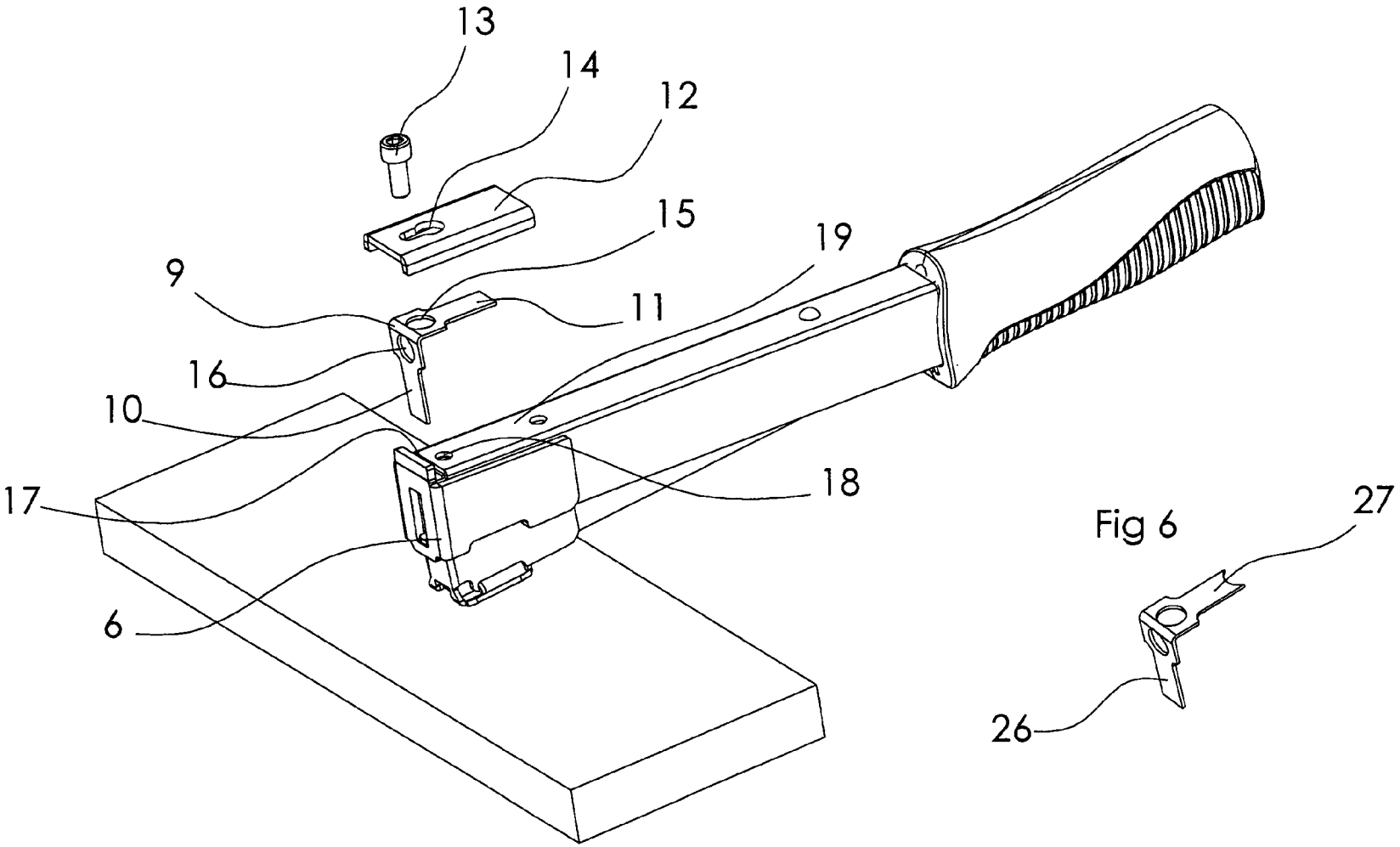
FIG. 3 is a view in which principal parts of the invention are shown exploded.
FIG. 6 shows a driver included in the present invention.
Figure 4:
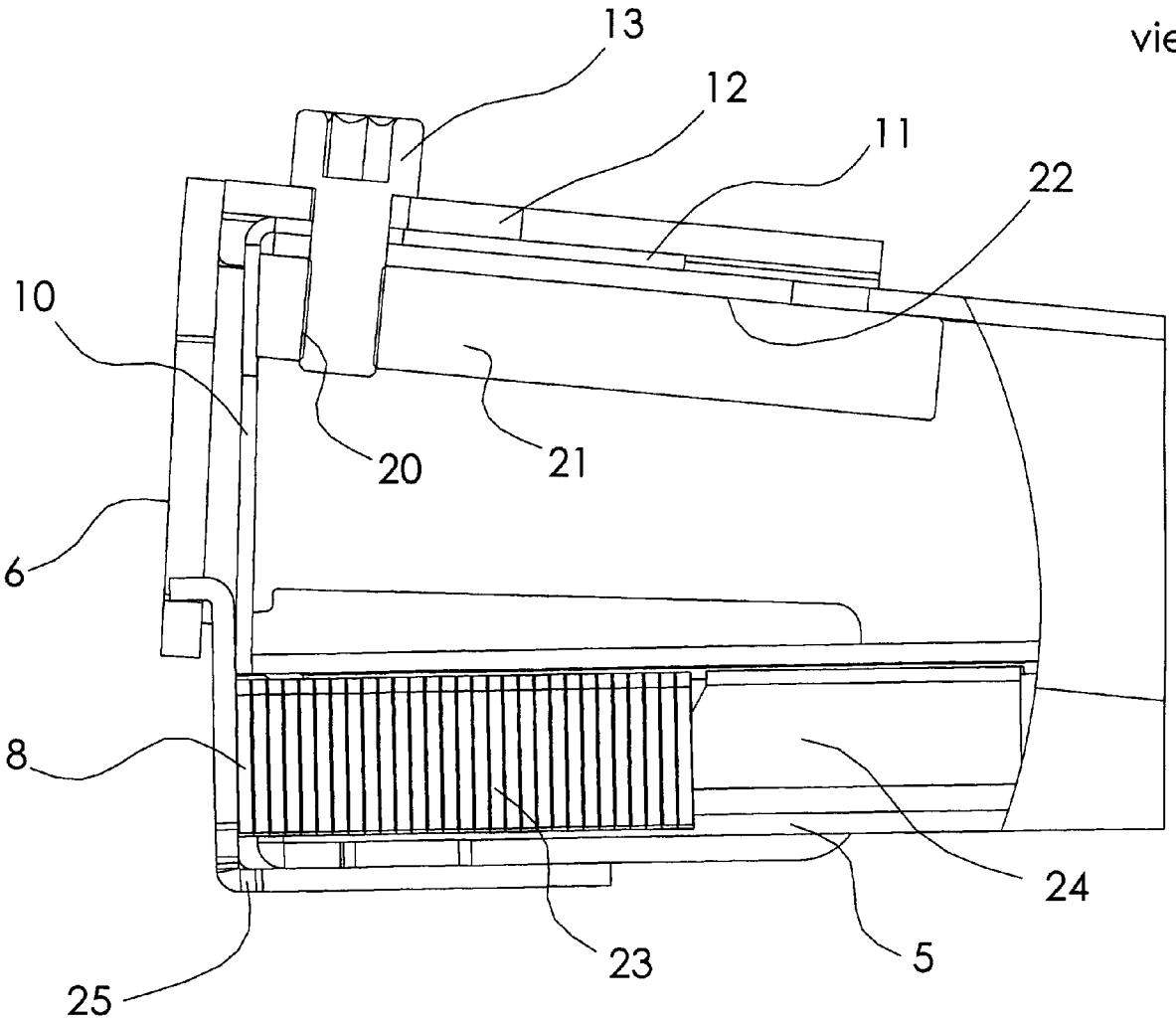
FIG. 4 is an enlarged view from line A-A in FIG. 1.
Figure 5:
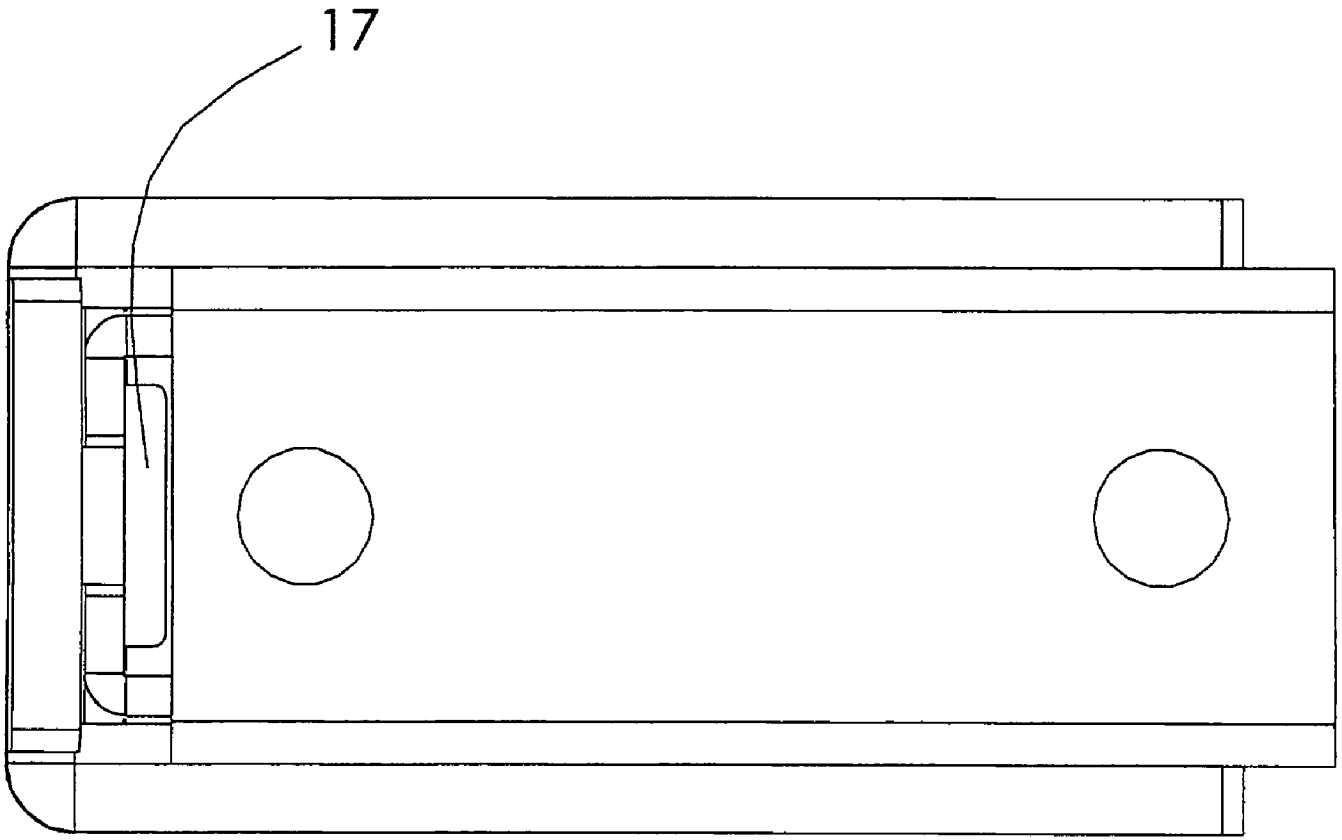
FIG. 5 is a detail view showing the front part of the hammer tacker in which view the driver is omitted.

FIG. 3 shows a driver 9 with a first driver blade 10 and a second driver blade 11. A washer 12 and a fastening means 13 in the form of a screw are also shown. The washer is provided with a first aperture 14 and the driver blade 11 is provided with a second aperture 15 and the driver blade 10 is provided with a third aperture 16. The arrangement also includes a slot 17 arranged in the front end of the magazine and a fourth aperture 18. With reference to FIGS. 3 and 4, the attachment of the driver to the magazine will hereinafter be explained. FIG. 4 is a view from line A-A in FIG. 1 and the parts facing the observer have been made transparent. To attach the driver 9 to the magazine, the driver blade 10 is moved down into the slot 17, which slot is clearly shown in FIG. 5, to a position in which the driver blade 11 contacts the outer side 19 of the magazine. Washer 12 is thereafter placed on the blade 11 and the screw 13 is placed through the apertures 14, 15 and 18 to a tightening engagement with a threaded hole 20 arranged in a block 21 which block is, in known manner, secured to the inner side 22 of the magazine.

FIG. 4 shows a staple row 23 placed on the rail 5. The row is pushed in the forward direction by a feeding device 24. In the front end of the magazine, an outlet opening 25 is arranged, and the front staple in the staple row is pushed to that opening. When the hammer tacker in a driving punch moves from the position shown in FIG. 1 to the position shown in FIG. 2, in which position the rail is in the magazine house, the blade 10 will hit the front staple 8 and force the staple into the work piece 7.

It is very simple to replace the driver blade if the blade, due to use, needs to be replaced. To replace the driver blade one unscrews screw 13, removes the washer 12, turns around the driver 9, and mounts the second driver blade 11 in the same way as described above. This operation is very simple to do since the whole operation is possible to do from the outer side of the magazine.

FIG. 6 shows a driver which comprises a first driver blade 26 and a second driver blade 27. These driver blades have different designs to facilitate use of staples having different designs.

The invention claimed is:

1. A hammer tacker with a driver member to drive staples into a work piece, the hammer tacker comprising a handle and a magazine to store the staples, wherein the magazine includes a magazine house and a magazine rail movable into and out of the magazine house, a feeding device being arranged in the magazine to feed the staples to an outlet opening of the magazine, and wherein the driver member includes a first driver blade and a second driver blade integral with the first driver blade, each driver blade being selectively detachably mountable at a first position on an outer side of the magazine to constitute an attachment portion for the other driver blade positioned in the magazine at an operating position in which the other driver blade is operable to engage and drive staples into the work piece.

2. A hammer tacker according to claim 1, wherein the first and second driver blades are of different shape.

3. A hammer tacker according to claim 2, wherein the attachment portion is detachably mounted to the outer side of the magazine by a screw arrangement.

4. A hammer tacker according to claim 1, wherein the attachment portion is detachably mounted to the outer side of the magazine by a screw arrangement.

5. A hammer tacker according to claim 1, wherein the first driver blade and the second driver blade are disposed at an angle relative to each other.

6. A hammer tacker according to claim 1, wherein the outer side of the magazine is a top side of the magazine.

7. A hammer tacker according to claim 6, wherein the first driver blade is substantially perpendicular to the second driver blade.

8. A hammer tacker with a driver member to drive staples into a work piece, the hammer tacker comprising a handle and a magazine to store the staples, wherein the magazine includes a magazine house and a magazine rail movable into and out of the magazine house, a feeding device being arranged in the magazine to feed the staples to an outlet opening of the magazine, wherein the driver member includes a first driver blade and a second driver blade integral with the first blade, the first driver blade being positioned in the magazine at an operating position for driving staples into the work piece and the second driver blade being detachably mounted at an attachment position on an outer side of the magazine, and wherein, when the second driver blade is detached from the outer side of the magazine, the first and second driver blades are removable as a unit from the magazine, and the second driver blade can then be disposed at the operating position by detachably mounting the first driver blade at the attachment position on the outer side of the magazine.

9. A hammer tacker according to claim 8, wherein the first and second driver blades are of different shape.

10. A hammer tacker according to claim 9, wherein the first and second driver blades are detachably mounted to the outer side of the magazine by a screw arrangement.

11. A hammer tacker according to claim 8, wherein the first and second driver blades are detachably mounted to the outer side of the magazine by a screw arrangement.

12. A hammer tacker according to claim 8, wherein the first driver blade and the second driver blade are disposed at an angle relative to each other.

13. A hammer tacker according to claim 8, wherein the outer side of the magazine is a top side of the magazine.

14. A hammer tacker according to claim 13, wherein the first driver blade is substantially perpendicular to the second driver blade.

* * * * *